US005229264A

United States Patent [19]

Pätzold et al.

[11] Patent Number: 5,229,264

[45] Date of Patent: Jul. 20, 1993

[54] PHOTOGRAPHIC SILVER HALIDE EMULSION

[75] Inventors: Walter Pätzold; Bruno Mücke, Bergisch Gladbach, both of Fed. Rep. of Germany

[73] Assignee: Agfa-Gevaert Aktiengesellschaft, Leverkusen, Fed. Rep. of Germany

[21] Appl. No.: 887,323

[22] Filed: May 22, 1992

[30] Foreign Application Priority Data

Jun. 6, 1991 [DE] Fed. Rep. of Germany ..... 4118542

[51] Int. Cl.[5] ..... G03C 1/005

[52] U.S. Cl. ..... 430/600; 430/567; 430/569; 430/605; 430/611; 430/604

[58] Field of Search ..... 430/600, 611, 604, 567, 430/569, 605

[56] References Cited

U.S. PATENT DOCUMENTS 2,440,110 4/1948 Mueller ..... 430/611

OTHER PUBLICATIONS

Chem. Pharm. Bull, 21 (1973), 2739.

*Primary Examiner*—Charles L. Bowers, Jr.
*Assistant Examiner*—Thorl Chea
*Attorney, Agent, or Firm*—Connolly & Hutz

[57] ABSTRACT

A quick-developing highly sensitive silver halide emulsion distinguished by steep gradation, a minimal increase in fog during storage, improved threshold gradation and low sensitivity to below-threshold pre-exposure is obtained by the addition of a diindoyl disulfide during preparation of the emulsion.

5 Claims, No Drawings

PHOTOGRAPHIC SILVER HALIDE EMULSION

This invention relates to a photographic silver halide emulsion distinguished by high maximum density, steep gradation, high sensitivity and rapid developability.

It is known that a high maximum density and rapid developability of a photographic material can be achieved by the use of a fine-grained silver halide emulsion.

A material of steep gradation is obtained by doping with $Rh^{3\oplus}$ and/or $Ir^{4\oplus}$ ions (DE-OS 2 226 877).

To produce highly sensitive silver halide emulsions of the type mentioned above, chemical ripening has to be carried out with a combination of gold and sulfur compounds (Ullmanns Encyklopädie der technischen Chemie, 4th Edition, Vol. 18, page 424).

In these emulsions, flat threshold gradation can occur as an unwanted side effect and can lead to a flattening of gradation and to an increase in fog. In addition, the intensive ripening required promotes a further increase in fog, above all after storage at normal or elevated temperature.

The problem addressed by the present invention was to avoid the described disadvantages, i.e. to produce a rapidly developable and highly sensitive silver halide emulsion which would be distinguished by steep gradation and, at the same time, a minimal increase in fog of the material during storage. Another problem addressed by the present invention was to obtain an improvement in threshold gradation and a reduction in sensitivity to below-threshold pre-exposure, for example darkroom light.

According to the invention, the solution to this problem is characterized in that a diindolyl disulfide is added to the silver halide emulsion before the beginning of chemical ripening.

Accordingly, the present invention relates to a photographic silver halide emulsion which is characterized in that the emulsion contains $10^{-7}$ to $10^{-3}$ mol/mol silver of a compound corresponding to formula (I)

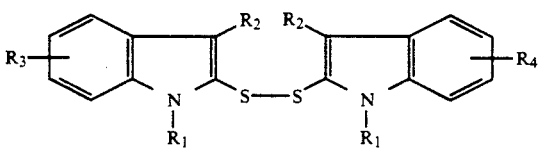

(I)

in which $R_1$ is H or alkyl, $R_2$ is alkyl, benzyl, phenyl or substituted phenyl, $R_3$ and $R_4$ represent H, alkyl, alkoxy, halogen or nitro.

The silver halide emulsion according to the invention is preferably doped with $10^{-9}$ to $10^{-4}$ mol/mol Ag $Rh^{3+}$ and/or $Ir^{4+}$ ions.

The emulsion is preferably ripened with gold and sulfur compounds, more particularly in a concentration of $2.10^{-6}$ to $2.10^{-4}$ mol gold compound/mol Ag and $10^{-6}$ to $10^{-4}$ mol sulfur compound/mol Ag.

Suitable silver halides are AgCl, AgBr, AgBrCl, AgBrI and AgBrClI.

The silver halide emulsion according to the invention preferably has a composition of $AgCl_{0.15}Br_{0.85}$ to $AgCl_{0.999}Br_{0.001}$. Particularly distinct effects are achieved in the case of so-called chloride emulsions, i.e. silver chloride bromide emulsions containing more than 80 mol-% and preferably more than 95 mol-% chloride.

The silver halide emulsion corresponding to the invention may be used for photographic materials, more particularly for color negative paper and black-and-white negative paper.

Accordingly, the present invention relates to a photographic material comprising a support and at least one photosensitive silver halide emulsion layer, characterized in that the silver halide emulsion of the silver halide emulsion layer contains a compound corresponding to formula (I) in a quantity of $10^{-7}$ to $10^{-3}$ mol/mol Ag.

The photographic material according to the invention may be color photographic material, for example a color negative film, a color negative paper, a color reversal film or a color reversal paper, or a black-and-white material, for example a black-and-white film or a black-and-white paper.

Suitable compounds for doping the silver halide emulsion according to the invention, are, for example, $Na_3RhCl_6$ and $Na_2IrCl_6$. Other suitable compounds are described in European patents 336 425, 336 426 and 336 427.

Suitable gold ripening agents are, for example, $H(AuCl_4)+KSCN$, $Na_3[Au(S_2O_3)_2]2H_2O$ and gold thiocyanate. Other gold ripening agents are known from German patents 854 883 and 848 910.

Suitable compounds for sulfur ripening are, for example, thiosulfates and thioureas, such as N,N-dimethyl thiourea and N-allyl thiourea and also thioacetamide.

The diindolyl disulfides according to the invention and their production are described in Chem. Pharm, Bull, 21 (1973), 2739. The diindolyl disulfides may be added during preparation of the emulsion. In one preferred embodiment, the compounds according to the invention are added at any time after the end of crystal formation and before the end of chemical ripening. In one particularly preferred embodiment, the compounds according to the invention are added immediately before the beginning of chemical ripening.

The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 8:1, the diameter of a crystal being defined as the diameter of a circle with an area corresponding to the projected area of the crystal. However, the layers may also contain platy silver halide crystals in which the diameter-to-thickness ratio is greater than 8:1.

The silver halide grains may also have a multiple-layer grain structure, in the most simple case with an inner and an outer core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al., Making and Coating Photographic Emulsion, The Focal Press, London (1966)).

Precipitation of the silver halide is preferably carried out in the presence of the binder, for example gelatine, in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which no nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, Fe, may be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. The gelatine may be oxidized. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous.

On completion of crystal formation or even at an earlier stage, the soluble salts are removed from the emulsion, for example by noodling and washing, by flocculation and washing, by ultrafiltration or by ion exchangers.

The photographic emulsions may contain compounds to prevent fogging or to stabilize the photographic function during production, storage or photographic processing.

In addition to the compounds according to the invention, suitable compounds of this type are azaindenes, preferably tetra- and pentaazaindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, (subst.) benztriazoles or benzthiazolium salts. Heterocycles containing mercapto groups are particularly suitable, examples of such compounds being mercaptobenzthiazoles, mercaptobenzimidazoles, mercaptotetrazoles,mercaptothiazoles,mercaptopyrimidines; these mercaptoazoles may even contain a water-solubilizing group, for example a carboxyl group or sulfo group. Other suitable compounds are published in Research Disclosure No. 17643 (1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.).

The photographic emulsions may be spectrally sensitized using methine dyes or other dyes. Particularly suitable dyes are cyanine dyes, merocyanine dyes and complex merocyanine dyes.

There is no need for sensitizers where the natural sensitivity of the silver halide is sufficient for a certain spectral region, as for example the blue sensitivity of silver bromide.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

The color photographic materials normally contain at least one red-sensitive silver halide emulsion layer, at least one green-sensitive silver halide emulsion layer and at least one blue-sensitive silver halide emulsion layer. Non-diffusing monomeric or polymeric color couplers are associated with these emulsion layers and may be arranged in the same layer or in an adjacent layer. Cyan couplers are normally associated with the red-sensitive layers, magenta couplers with the green-sensitive layers and yellow couplers with the blue-sensitive layers.

Color couplers for producing the cyan component dye image are generally couplers of the phenol or α-naphthol type, of which suitable examples are known from the literature.

Color couplers for producing the yellow component dye image are generally couplers containing an open-chain ketomethylene group, more especially couplers of the α-acyl acetamide type, of which suitable examples are α-benzoyl acetanilide couplers and α-pivaloyl acetanilide couplers which are also known from the literature.

Color couplers for producing the magenta component dye image are generally couplers of the 5-pyrazolone, indazolone or pyrazoloazole type of which any number of suitable examples can be found in the literature.

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are the known DIR couplers and also DAR and FAR couplers.

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group, so that coupling products which are diffusible or which at least show slight or limited mobility are obtained in the reaction with color developer oxidation products (U.S. Pat. No. 4,420,556).

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP- A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphoric acid esters, citric acid esters, benzoic acid esters, alkyl amides, fatty acid esters and trimesic acid esters.

Color photographic material typically comprises at least one red-sensitive emulsion layer, at least one green-sensitive emulsion layer and at least one blue-sensitive emulsion layer on the support. The order of these layers may be varied as required. Couplers forming cyan, magenta and yellow dyes are normally incorporated in the red-, green- and blue-sensitive emulsion layers. However, different combinations may also be used.

Each of the differently sensitized photosensitive layers may consist of a single layer or may even comprise two or more partial silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive intermediate layers generally arranged between layers of different spectral sensitivity may contain agents to prevent unwanted diffusion of developer oxidation products from one photosensitive layer into another photosensitive layer with different spectral sensitization.

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers and other auxiliaries.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,015,229) or benzoxazole compounds (U.S. Pat. No. 3,700,455).

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, pages 22 et seq.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643, December 1978, Chapter XVI, pages 22 et seq.).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The binders of the material according to the invention, particularly where gelatine is used as binder, are hardened with suitable hardeners, for example with hardeners of the epoxide type, the ethylenium type, the acryloyl type or the vinyl sulfone type. Hardeners of the diazine, triazine or 1,2-dihydroquinoline series are also suitable.

The binders of the material according to the invention are preferably hardened with instant hardeners.

Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Suitable examples of instant hardeners can be found, for example, in European patent 313 949.

The materials according to the invention are processed in the usual way by the recommended processes.

EXAMPLE 1

The following solutions are prepared using demineralized water:

| | | |
|---|---|---|
| Solution 1: | 7,000 ml | water |
| | 540 g | gelatine |
| Solution 2: | 7,000 ml | water |
| | 1,300 g | NaCl |
| | 21.5 g | KBr |
| | $5 \cdot 10^{-5}$ g | $K_2IrCl_6$ |
| | $3 \cdot 10^{-5}$ g | $Na_3RhCl_6$ |
| Solution 3: | 7,000 ml | water |
| | 3,000 g | $AgNO_3$ |

Solutions 2 and 3 are simultaneously added to solution 1 with intensive stirring over a period of 120 minutes at 50° C. and at a pAg value of 7.7. A silver chloride emulsion having an average particle diameter of 0.8 μm is obtained. The ratio by weight of gelatine to $AgNO_3$ is 0.18. The emulsion is flocculated in known manner, washed and redispersed with gelatine in such a quantity that the ratio by weight of gelatine to $AgNO_3$ is 1.0. The emulsion contains 1 mol silver halide per kg. The emulsion is then optimally ripened with 3.5 μmol gold chloride/mol Ag and 1.5 μmol $Na_2S_2O_3$/mol Ag at a pH value of 4.5. After chemical ripening, the emulsion (silver halide composition: $AgCl_{0.99}Br_{0.01}$) is stabilized and sensitized for the blue spectral region.

A solution of the yellow coupler

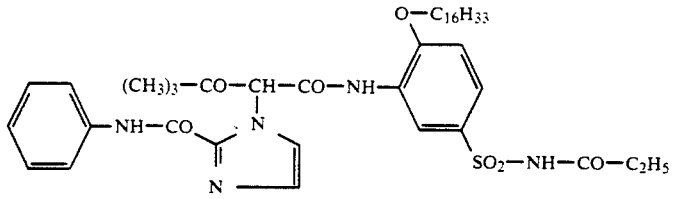

and the white coupler

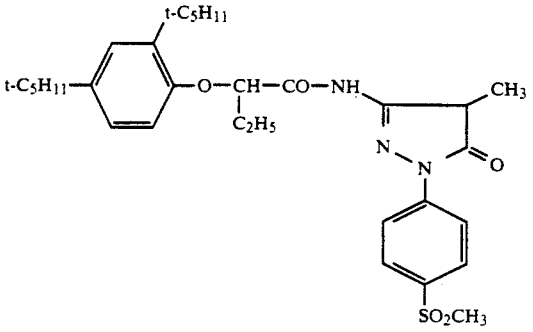

in tricresyl phosphate is then added to the emulsion. The emulsion is then applied to a layer support of paper coated on both sides with polyethylene.

The layer contains per $m^2$: 0.63 g $AgNO_3$, 1.38 g gelatine, 0.95 g yellow coupler, 0.2 g white coupler, 0.29 g tricresyl phosphate.

A protective layer of 0.2 g gelatine and 0.3 g hardener corresponding to the following formula

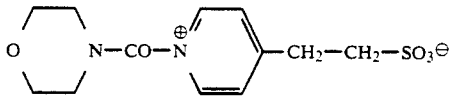

per $m^2$ is then cast over this layer. The material is exposed to form an image and processed by the Ektacolor RA 4 process.

EXAMPLE 2

The emulsion is prepared and processed in the same way as described in Example 1, except that 4.5 mg diphenyl indolyl disulfide in the form of a 0.1% by weight solution in acetone is added before the thiosulfate during chemical ripening.

EXAMPLE 3

The emulsion is prepared and processed in the same way as described in Example 1, except that 225 mg diphenyl indolyl disulfide are added before the thiosulfate during chemical ripening.

The sensitometric results are set out in Table 1.

TABLE 1

| Test | $D_{min.}(1)$ | $D_{min.}(2)$ | lg I · t | $G_1$ | $G_2$ |
|---|---|---|---|---|---|
| +1 | 0.111 | 0.174 | 2.055 | 1.67 | 3.69 |
| *2 | 0.109 | 0.130 | 1.997 | 1.90 | 4.20 |
| *3 | 0.107 | 0.123 | 1.981 | 2.12 | 4.45 |

$D_{min.}(1)$ Fog after 1 day
$D_{min.}(2)$ Fog after 6 months (storage at 20° C.)
lgI · t Sensitivity
$G_1$ Threshold gradation
$G_2$ Shoulder gradation
+ Comparison Example
*Invention

EXAMPLE 4

The following solutions are prepared using demineralized water:

| | | |
|---|---|---|
| Solution 1: | 8,000 ml | water |
| | 360 g | gelatine |
| | 10 g | NaCl |
| Solution 2: | 6,000 ml | water |
| | 390 g | NaCl |
| | 700 g | KBr |
| | $4 \cdot 10^{-4}$ g | $Na_3RhCl_6$ |
| Solution 3: | 6,000 ml | water |
| | 2,000 g | $AgNO_3$ |

Solutions 2 and 3 are simultaneously added to solution 1 with intensive stirring over a period of 60 minutes at 55° C. and at a pAg of 7.8. The emulsion is flocculated in known manner, washed and redispersed with addition of gelatine, phenol (as preservative) and water. The emulsion contains 0.9 mol silver halide per kg. The emulsion is then ripened for 120 minutes at 52° C. by addition of 10 μmol $HAuCl_4$/mol Ag and 20 μmol $Na_2S_2O_3$/mol Ag. The emulsion (silver halide composition: $AgCl_{0.5}Br_{0.5}$) is then cast onto a paper support—coated on both sides with polyethylene—with addition of sensitizers, stabilizers, plasticizer latex, optical brighteners, developer substances and hardeners. The material is exposed to form an image and processed by the AGFA 100 method.

EXAMPLE 5

The emulsion is prepared and processed in the same way as described in Example 4, except that 160 mg diphenyl indolyl disulfide are added before the ripeners during chemical ripening.

EXAMPLE 6

The emulsion is prepared and processed in the same way as described in Example 4, except that the sensitometric data are measured after storage for 2 days at 60° C.

EXAMPLE 7

The emulsion is prepared and processed in the same way as described in Example 5, except that the sensitometric data are measured after storage for 2 days at 60° C.

EXAMPLE 8

The emulsion is prepared and processed in the same way as described in Example 4, except that the material is developed after additional diffuse exposure through an amber filter (corresponding to Draft ISO/DIS 8374).

EXAMPLE 9

The emulsion is prepared and processed in the same way as described in Example 5, except that the material is developed after additional diffuse exposure through an amber filter (corresponding to Draft ISO/DIS 8374).

The sensitometric results are set out in Table 2.

TABLE 2

| Test | S | $D_{min.}$ | lg I · t | ER | $D_{max}$ | $G_1$ | $G_2$ |
|---|---|---|---|---|---|---|---|
| +4 | 0.005 | 0.081 | 2.27 | 0.60 | 2.13 | 1.75 | 4.50 |
| *5 | 0.002 | 0.080 | 2.26 | 0.52 | 2.13 | 2.17 | 4.67 |
| +6 | | 0.341 | 2.70 | 1.06 | 2.14 | 0.58 | 2.74 |
| *7 | | 0.174 | 2.57 | 0.85 | 2.12 | 1.50 | 3.00 |
| +8 | | 0.220 | 2.52 | 1.29 | 2.11 | 1.33 | 4.38 |

TABLE 2-continued

| Test | S | $D_{min}$ | lg I · t | ER | $D_{max}$ | $G_1$ | $G_2$ |
|---|---|---|---|---|---|---|---|
| *9 | | 0.086 | 2.27 | 0.60 | 2.14 | 2.06 | 4.53 |

S $D_{min}$-$D_{substrate}$
$D_{min}$ Fog
lgI · t Sensitivity
ER Exposure range
$D_{max}$ Maximum density
$G_1$ Threshold gradation
$G_2$ Shoulder gradation
+ Comparison Example
*Invention

We claim:

1. A photographic silver halide emulsion containing $10^{-7}$ to $10^{-3}$ mole of a compound corresponding to formula (I) per mole of silver

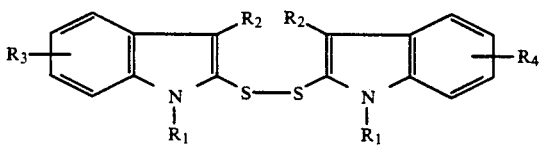

(I)

in which
$R_1$ is H or alkyl,
$R_2$ is alkyl, benzyl, phenyl or substituted phenyl,
$R_3$ and $R_4$ are H, alkyl, alkoxy, halogen or nitro.

2. The photographic silver halide emulsion as claimed in claim 1, is doped with $10^{-9}$ to $10^{-4}$ mole of $Rh^{3+}$ and/or $Ir^{4+}$ ions per mole of silver.

3. The photographic silver halide emulsion as claimed in claim 1, characterized in that $2.10^{-6}$ to $2.10^{-4}$ mole of gold compound and $10^{31\ 6}$ to $10^{-4}$ mole of sulfur compound per mole of silver are used to ripen the emulsion.

4. The photographic silver halide emulsion as claimed in claim 1, has a composition of $AgCl_{0.15}Br_{0.85}$ to $AgCl_{0.999}Br_{0.001}$.

5. A photographic silver halide material comprising a support and at least one photosensitive silver halide emulsion layer, characterized in that the silver halide emulsion layer contains the silver halide emulsion claimed in claim 1.

* * * * *